United States Patent [19]

Koyama et al.

[11] Patent Number: 4,913,569

[45] **Date of Patent: * Apr. 3, 1990**

[54] WIRE-TYPE PRINTING HEAD

[75] Inventors: Tatsuya Koyama; Tetsuhiro Yamada; Hirokazu Ando; Katsuya Kamimura, all of Tokyo, Japan

[73] Assignee: Oki Electric Industry Co., Ltd., Tokyo, Japan

[ * ] Notice: The portion of the term of this patent subsequent to Apr. 12, 2006 has been disclaimed.

[21] Appl. No.: 335,813

[22] Filed: Apr. 10, 1989

Related U.S. Application Data

[63] Continuation of Ser. No. 122,240, Nov. 17, 1987, Pat. No. 4,820,065.

[30] Foreign Application Priority Data

Nov. 25, 1986 [JP] Japan ..... 61-179816

[51] Int. Cl.[4] ..... B41J 3/10

[52] U.S. Cl. ..... 400/124; 101/93.05

[58] Field of Search ..... 400/124; 101/93.04, 101/93.05

[56] References Cited

U.S. PATENT DOCUMENTS

| | | | |
|---|---|---|---|
| 4,348,120 | 9/1982 | Isobe et al. | 400/124 |
| 4,368,353 | 1/1983 | Ando et al. | 101/93.05 X |
| 4,377,348 | 3/1983 | Isobe et al. | 400/124 |
| 4,447,166- | 5/1984 | Ochiai et al. | 101/93.05 X |
| 4,511,269 | 4/1985 | Takahashi et al. | 101/93.05 X |
| 4,523,867 | 6/1985 | Berrey et al. | 400/124 |
| 4,552,471 | 11/1985 | Gugel et al. | 101/93.05 X |
| 4,568,207 | 2/1986 | Hara et al. | 101/93.05 X |
| 4,583,871 | 4/1986 | Ochiai et al. | 400/124 |
| 4,597,680 | 7/1986 | Norigoe et al. | 400/124 |
| 4,600,323 | 7/1986 | Harada et al. | 101/93.05 X |
| 4,696,589 | 9/1987 | Okundo et al. | 101/93.05 X |

OTHER PUBLICATIONS

IBM Tech. Disc. Bulletin, "Magnetic Compensation and Cooling Technique for a Stored Energy Print Actuator", vol. 24, No. 3, Aug. 1981, pp. 1702–1704.

*Primary Examiner*—Edgar S. Burr
*Assistant Examiner*—James R. McDaniel
*Attorney, Agent, or Firm*—Wenderoth, Lind & Ponack

[57] ABSTRACT

A wire-type print head comprises an armature to which a rear end of a printing wire is fixed, a core having its forward end adjacent to a rear surface of the armature, a leaf spring having a first end fixed near a permanent magnet and a second end fixed to the armature, and an auxiliary core positioned between the permanent magnet and the core, and having a forward end adjacent to the rear surface of the armature. An electric current is made to flow through a coil wound on the core for generating a magnetic flux through the core in a direction to cancel the magnetic flux due to the permanent magnet. When the coil is not energized the armature is attracted toward the core to resiliently deform the leaf spring. When the coil is energized the armature is released and moved forward by the action of the leaf spring. The rear surface of the armature is kept in contact with the front end of the auxiliary core so that the front end of the auxiliary core forms a fulcrum point for swinging of the armature.

12 Claims, 6 Drawing Sheets

WIRE-TYPE PRINTING HEAD

This is a continuation of application Ser. No. 07/122,240, filed Nov. 17, 1987 now U.S. Pat. No. 4,820,065.

BACKGROUND OF THE INVENTION

The present invention relates to wire-type printing heads used in serial printers and operating on a principle of energy of deformation accumulated in a leaf spring under the effect of the magnetic energy of a permanent magnet with subsequent conversion of the above-mentioned energy of deformation into the energy of printing due to the electric current which is passed, in accordance with a data to be printed, through a coil to create an electromagnetic force cancelling the attractive force of the permanent magnet.

Many types of wire-type printing heads have been known in the past, one example of which is shown in Figs. 1 and 2 of the attached drawings.

FIG. 1 is a semi-sectional view of a known spring-loaded wire-type printing head, and FIG. 2 is a sectional view along line A—A of FIG. 1.

In the drawings, reference numeral 1 designates a disk-shaped rear yoke. Stacked on the peripheral surface of rear yoke 1 are a permanent magnet 2, an intermediate yoke 3, and an armature yoke 4. One end of a leaf spring 5 is rigidly clamped between armature yoke 4 and intermediate yoke 3. The leaf spring 5 extends radially inward, i.e., toward the center of the disk-shaped rear yoke 1.

Fixed to the free end of leaf spring 5 is an armature 6 which operates on its free end the base (rear end) of a printing wire 7 which is rigidly attached thereto. The tip (front end) of printing wire 7 is arranged so that it can project through a guide portion 8*a* of a wire guide 8.

Located in the central portion of rear yoke 1 is a core 9 which is surrounded by a coil 10.

Although there are a plurality of wires 7, armatures 6 respectively supporting the wires 7, leaf springs 5 respectively supporting the armatures 6, and cores 9 respectively associated with the armatures 6, only one of each is illustrated for simplicity of illustration.

Reference numeral 11 designates a center pole which forms a magnetic path for a magnetic flux generated by coil 10. Reference numeral 12 designates a magnetic path formed by permanent magnet 2.

When coil 10 in the above-described structure is not energized, the magnetic flux developed by permanent magnet 2 flows through magnetic path 12, i.e., passes through intermediate yoke 3, armature yoke 4, armature 6, core 9 and rear yoke 1 and then is closed back to permanent magnet 2. Because of the force of magnetic attraction between core 9 and armature 6, the above-mentioned armature 6 is attracted by core 9, so that leaf spring 5 is deformed into a loose S-shaped form, thereby accumulating the energy of deformation.

If under this condition, coil 10 is energized, the magnetic flux developed by coil 10 will overcome the magnetic force developed by permanent magnet 2. Therefore, armature 6 will be released from core 9. As a result, the energy of deformation accumulated in leaf spring 5 also will be released, spring 5 will return to its natural state, and armature 6 will turn around its fulcrum point formed by an outer edge (left edge in the cross section of FIG. 1) of core 9. As a result, the tip of printing wire 7, which is fixed to armature 6, will be ejected in the forward (upward as seen in the figure) direction through guide portion 8*a* and will print a dot forming part of a character or the like onto a printing medium through an ink ribbon (not shown) placed between the tip of the wire and the recording medium.

During the printing operation, the magnetic flux due to the coil 10 will tend to avoid the "difficult" or oppositely directed magnetic path 12, and will flow through "easy" magnetic path 13.

However, for reduction of an equivalent mass, the end of armature 6 fixed to the wire is so formed to have a minimum strength to withstand the impact force developed by printing. Thus, from the dynamic point of view, the mechanism should have as light a weight as possible. But then magnetic path 13 is insufficient.

Apart from the flow in the direction opposite to that in magnetic path 12, the demagnetization flux of coil 10 creates interferences by flowing through paths 14*a*, 14*b* formed by adjacent armatures 6II, 6III and cores 9II and 9III (FIG. 2).

These interferences can be eliminated only with installation of completely independent magnetic circuits for adjacent drive elements which, however, will make the construction extremely complicated.

Thus, the known wire-type printing heads have an inefficient path for the demagnetization flux developed by the coil, and until now the problem of magnetic interference in these devices has not yet been solved.

SUMMARY OF THE INVENTION

It is an object of the present invention to eliminate the above disadvantages by providing a low-power consumption wire printing head having an efficient flow of demagnetization flux and characterized by a reduced magnetic interference.

This object is achieved by the provision of an auxiliary core which forms an independent magnetic flux by means of a coil installed between the permanent magnet and the core. The end of the above-mentioned auxiliary core serves as a fulcrum point for the armature.

When the drive current is passed through the coil, the magnetic flux developed by the coil flows through the core in the direction opposite to that of the magnetic flux developed by the permanent magnet, passes through the armature, enters the auxiliary core, and thereby can efficiently suppress the magnetic flux of the permanent magnet.

As the end of the auxiliary core is used as a fulcrum point for rocking movements of the armature, the permanent magnet flux which enters the auxiliary core exerts almost no effect on the force of magnetic attraction developed by the armature.

As a result, the magnetic fluxes of the coils penetrate, to a lesser extent, into the adjacent armatures and cores, and the total magnetic interferences are reduced.

DETAILED DESCRIPTION OF THE EMBODIMENTS

Figure 1:
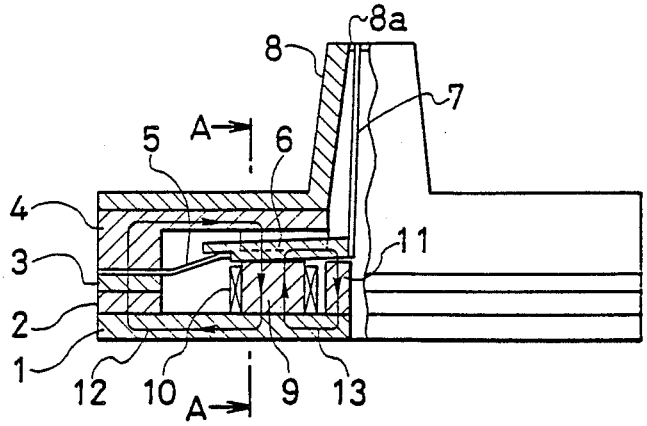
FIG.1 PRIOR ART
FIG. 1 is a semi-sectional view illustrating a known device.
Figure 2:
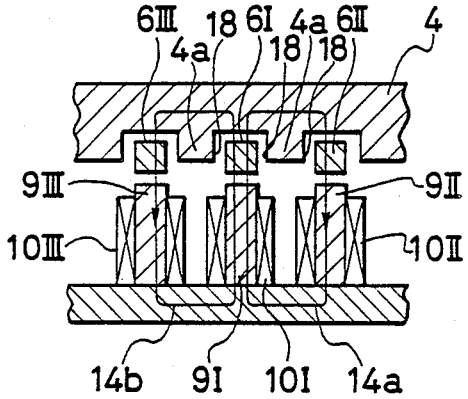
FIG.2 PRIOR ART
FIG. 2 is a sectional view along line A—A of FIG. 1.
Figure 3:
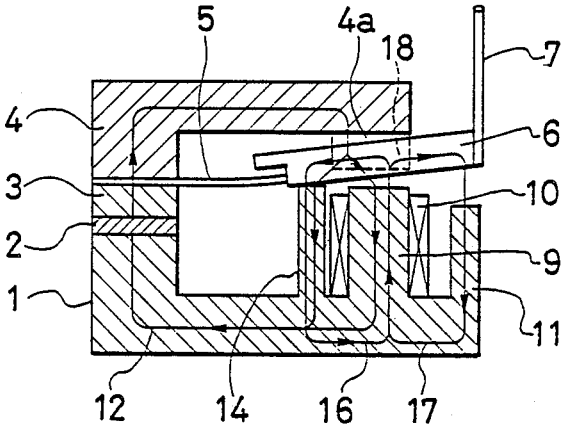
FIG. 3 is a sectional view of a wire-type printing head made in accordance with the first embodiment of the invention.
Figure 3A:
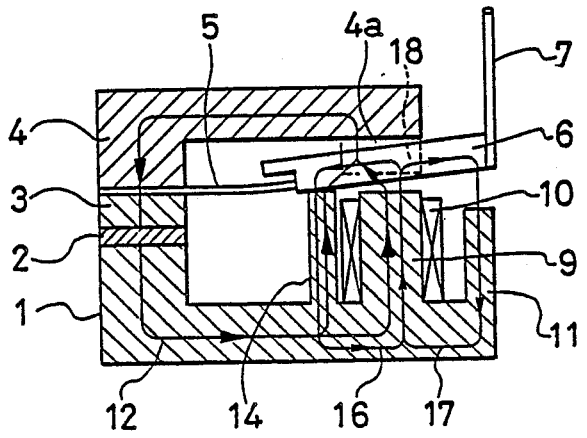
FIG. 3A is a view similar to FIG. 3 but illustrating a modification of flux flow therein.
Figure 4A:
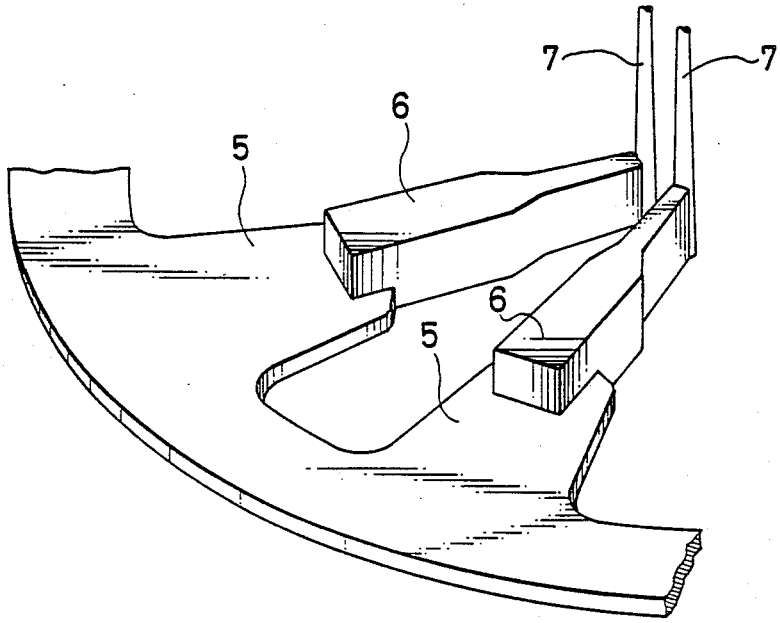
FIG. 4A is a perspective view of armatures and leaf springs 5.
Figure 4B:
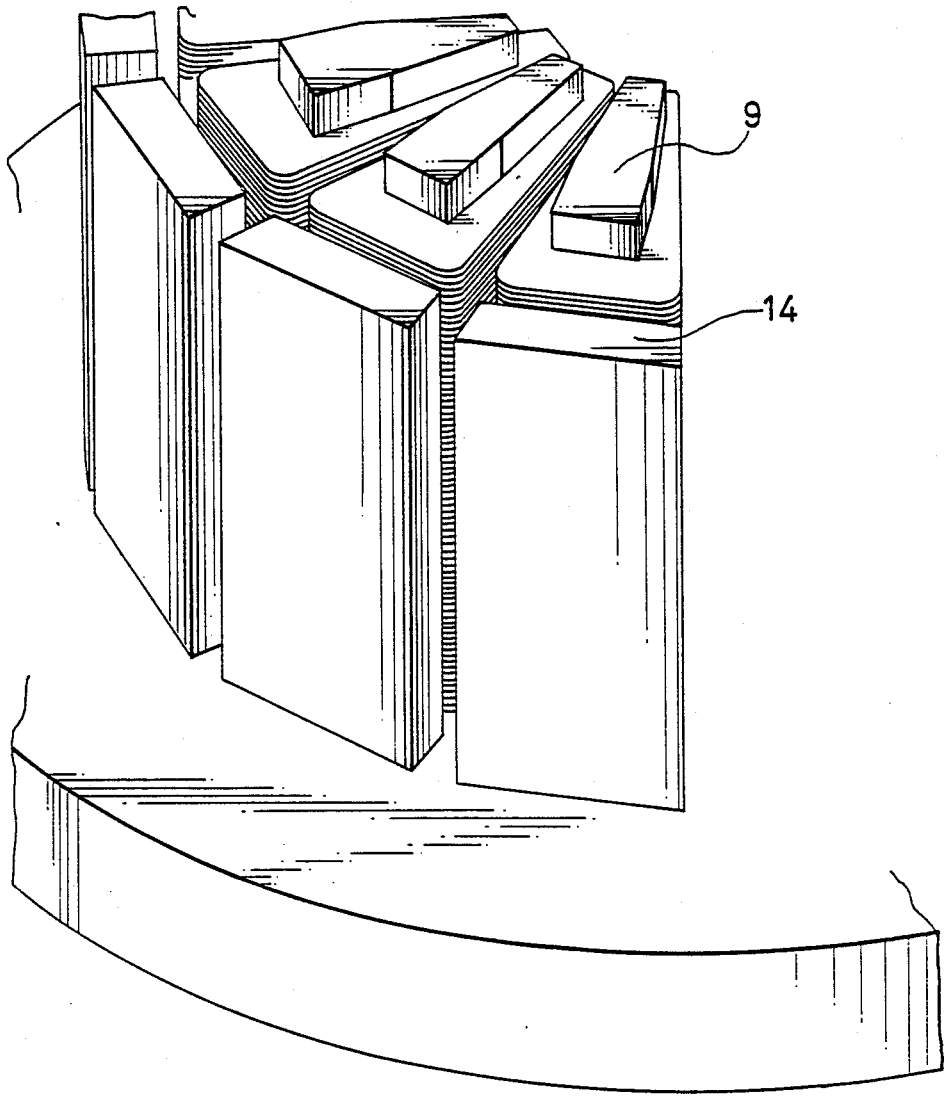
FIG. 4B is a perspective view of cores, coils and auxiliary cores of the wire printing head.

The invention will now be described in detail with reference to the accompanying drawings, wherein FIGS. 3 and 3A are sectional views illustrating a wire printing head made in accordance with the first embodiment of the invention. FIG. 4B is a perspective view of cores, coils and auxiliary cores of the same wire printing head. FIG. 4A is a perspective view of armatures and leaf springs positioned above the cores, coils and auxiliary cores.

in FIGS. 3, 3A, 4A and 4B, the device comprises a rear yoke 1 which carries an auxiliary core 14, a core 9, and a center pole 11, all these parts being arranged sequentially in the stated order in a radial direction toward the center, with their axial ends facing an armature 6.

The above-mentioned auxiliary core 14 forms a separate path 16 for a magnetic flux developed by a coil 10. Auxiliary core 14 is made of the same ferromagnetic material as core 9 as both cores are part of one piece of ferromagnetic material which also forms the rear yoke 1. Core 14 is disposed to form a predetermined gap between it and the core 9, on the radial side of the core 9 facing a permanent magnet 2 fixed to an axial end of the rear yoke 1.

The forward (top as seen in the figure) axial end of auxiliary core 14 is used as a fulcrum point for swinging motions of armature 6. The above-mentioned armature has a cross section sufficient for magnetic paths. The magnetic paths include magnetic path 12 of the flux generated by permanent magnet 2 (flowable in either direction as seen by comparing FIGS. 3 and 3A) and magnetic paths 16 and 17 of the fluxes generated by coil 10. Among these, magnetic path 16 passes through auxiliary core 14, and magnetic path 17 passes through central pole 11.

In order to eliminate a decrease in the force of attraction developed by armature 6 when the magnetic flux of permanent magnet 2 passes through auxiliary core 14, the above-mentioned armature 6 and opposing parts 18 of adjacent downward protrusions 4*a* on an annular part of armature yoke 4 that are adjacent to the side surfaces of armature 6 are located near or above core 9, or they can be arranged so that a distance between auxiliary core 14 and permanent magnet 2 is substantially greater than the gap between core 9 and auxiliary core 14.

Reference numeral 3 designates an intermediate yoke, 5 is a leaf spring, and 7 is a printing wire.

The proposed wire-type printing head operates as follows:

When coil 10 is not energized, the flux of permanent magnet 2 passes through armature 6 to auxiliary core 14, and enters core 9 as shown in FIG. 3 (or reversely as shown in FIG. 3A). As a result, armature 6 is turned on auxiliary core 14 as a fulcrum point, and is attracted by core 9.

The force of attraction of armature 6 imparts torque to armature 6 causing rotation thereof about the fulcrum point formed by the top portion of auxiliary core 14. Moreover, almost all of the torque is developed by core 9. The portion of the magnetic flux which flows through auxiliary core 14 and is developed by permanent magnet 2 exerts almost no influence on the force of attraction of armature 6.

When, on the other hand, coil 10 is energized, the flux induced by coil 10 flows through the core 9 in a direction opposite to that of the flux induced by permanent magnet 2, passes through armature 6, flows through auxiliary core 14, and at the same time enters central pole 11.

As a result, a degree of penetration of the flux of coil 10 to the adjacent armature and core is decreased, and a degree of magnetic interference is reduced as well.

Figure 5:
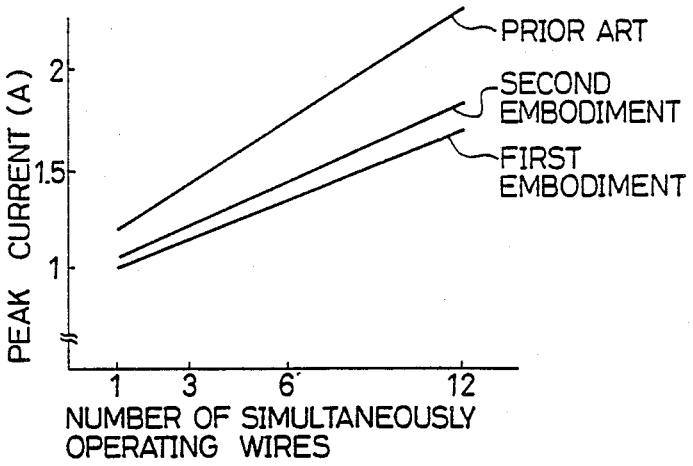
FIG. 5 is a graph which shows a relationship between the number of simultaneously-operating wires and peak current of the coil.
Figure 6:
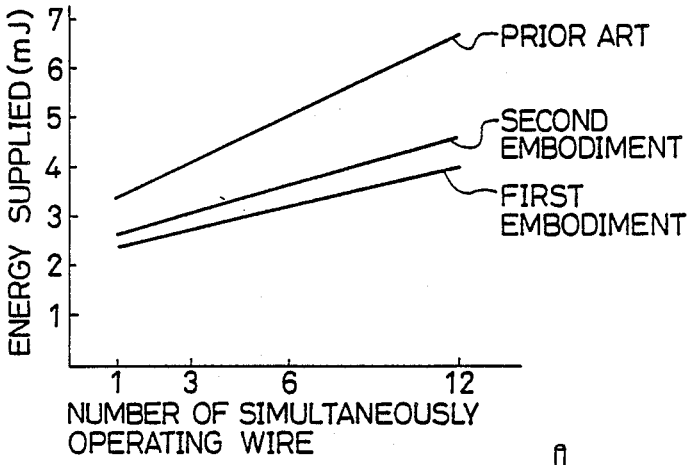
FIG. 6 is a graph which shows a relationship between the number of simultaneously-operating wires and the energy supplied to the coil.

FIGS. 5 and 6 show experimental data. More particularly, FIG. 5 is a graph which illustrates a relationship between peak currents of the coil and the number of simultaneously operating wires. FIG. 6 is a graph showing the relationship between the number of simultaneously operating wires and the energy supplied to the coil.

As follows from these graphs, although the first embodiment does not completely remove the magnetic interference, as far as the peak current is concerned, the ratio of an increase in the current in the case of twelve simultaneously operating wires, as compared to one wire, corresponds to the following:

Prior art: 2.6(A)/1.4(A)=1.86

First embodiment of the invention: 1.7(A)/1(A)=1.7

Similar relationships with regard to the energy supplied to the coil are as follows:

Prior art: 6.7(mJ)/3.4(mJ)=1.97

First embodiment of the invention: 4(mJ)/2.4(mJ)=1.67.

This data confirms the efficiency of the invention.

By arranging a separate magnetic path 16 for the flux of coil 10, it is possible to still further reduce absolute values of the peak current and supplied energy, as compared to the same parameters of the known device. This will result in an increased efficiency of printing.

Figure 7:
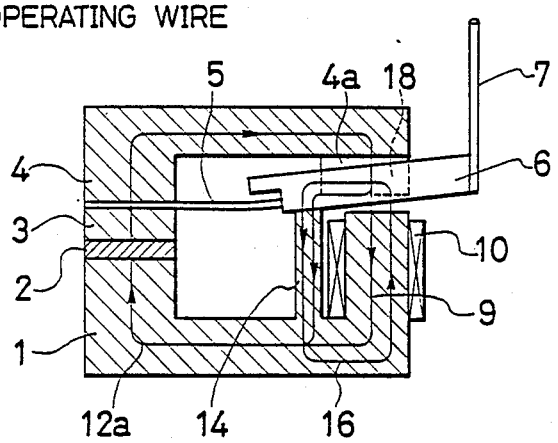
FIG. 7 is a sectional view illustrating the second embodiment of the device.

FIG. 7 is a sectional view of a wire-type printing head corresponding to the second embodiment of the proposed device.

In principle, the device of the second embodiment is similar to that of the first embodiment, except that it does not have a central pole.

Because the provision of auxiliary core 14 results in an increased efficiency, the absence of the central pole does not essentially affect this efficiency. This is illustrated by the graphs shown in FIGS. 5 and 6.

As the device of the second embodiment operates in the same manner as the device of the first embodiment, it does not require special explanation.

It should be understood that the present invention is not limited to the above-described first and second embodiments, and that various modifications of the device are possible.

In the first and second embodiments illustrated above, the auxiliary core and the main core are made from the same pice of material. It is obvious, however, that these parts can be made from different materials, provided that both these materials have ferromagnetic characteristics.

For example, the main core can be made from Permendur, or a similar material with properties of high magnetic saturation, while the auxiliary core is produced from silicon steel.

Figure 8:
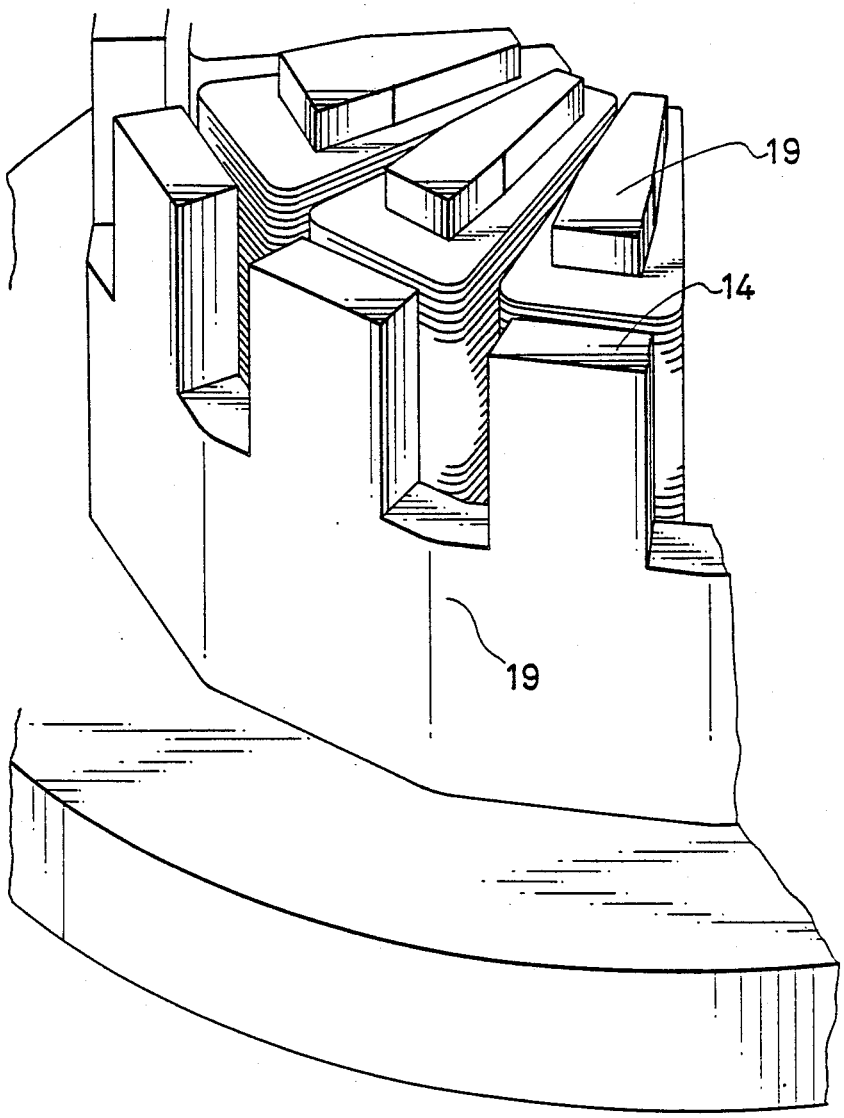
FIG. 8 is a perspective view, similar to FIG. 4, showing a further embodiment of the invention.

In the embodiments described, the auxiliary cores 14 extend separately from the rear yoke 1. But, alternatively, lower parts of the auxiliary cores 14 may be connected by bridging members 19, as shown in FIG. 8. The bridging members 19 can be of the same magnetic material as the auxiliary cores 14 and can be formed integrally with them.

Because, as has been shown above, the proposed device contains an auxiliary core which is located on the side of the permanent magnet of the core and forms a separate magnetic path for a flux developed by the coil, and because the top end of this auxiliary core serves as a fulcrum point for rock movements of the armature, the flux developed by the coil can more efficiently flow through the auxiliary core.

This makes it possible to reduce the energy consumed by the coil per each drive, and at the same time to reduce magnetic interference between adjacent fluxes. The result is a decreased energy consumption.

An additional effect is that the coil does not generate heat, and printing can be performed in a high-duty mode.

What is claimed is:

1. A wire-type print head comprising:

a printing wire extending forward, an armature to which a rear end of the wire is fixed, a main core having a forward end thereof adjacent to a rear surface of the armature, a coil wound on the main core, a permanent magnet, a leaf spring having a first end fixed near the permanent magnet and a second end fixed to the armature, an auxiliary core positioned between the permanent magnet and the main core, and having a forward end thereof adjacent to and engageable with the rear surface of the armature, first magnetic path means for completing a closed magnetic path for the magnetic flux from the permanent magnet, second magnetic path means for completing a closed magnetic path for the magnetic flux means for causing an electric current to flow through the coil for generating a magnetic flux through the main core in a direction to cancel the magnetic flux through the main core from the permanent magnet, wherein when the coil is not energized the armature is attracted toward the main core to resiliently deform the leaf spring, and when the coil is energized the armature is released and moved forward by the action of the leaf spring, and the rear surface of the armature is kept in contact with the front end of the auxiliary core so that the front end of the auxiliary core forms a fulcrum point for swinging of the armature.

2. A print head according to claim 1, wherein said first magnetic path means includes a rear yoke connecting the permanent magnet and the main core, and an armature yoke having one end adjacent to a front or side surface of the armature and having another end magnetically coupled to the permanent magnet.

3. A print head according to claim 2, wherein the auxiliary core extends forward from the rear yoke.

4. A print head according to claim 2, wherein said armature yoke has protrusions, each of which has a side surface adjacent to a side surface of the armature.

5. A print head according to claim 4, wherein said armature yoke has an annular armature yoke part and said protrusions extend rearward from the annular part.

6. A print head according to claim 5, wherein said protrusions are opposite to said main core so that the magnetic flux from the permanent magnet through the main core passes dominantly through the armature yoke back to the permanent magnet.

7. A wire-type print head comprising:

printing wires extending forward substantially parallel with each other, armatures in association with the respective print wires, a rear end of each print wire being fixed to a respective one of the associated armatures, main cores in association with the respective armatures, each main core having a forward end adjacent to a rear surface of a respective one of the armatures, coils in association with the respective main cores, each of the coils being wound on a respective one of the main cores, a permanent magnet, leaf springs in association with the respective armatures, each leaf spring having a first end fixed near the permanent magnet and a second end fixed to a respective one of the armatures, auxiliary cores in association with the respective main cores, each auxiliary core being positioned between the permanent magnet and a respective one of the main cores, and having a forward end adjacent to a rear surface of a respective one of the armatures, said permanent magnet being in the form of ring surrounding said armatures, said main cores, said leaf spring and said auxiliary cores, first magnetic path means for completing a closed magnetic path for the magnetic flux from the permanent magnet, through the main cores and the armatures, second magnetic path means for completing a closed magnetic path for the magnetic flux from the main cores through the armatures and the auxiliary cores, means for causing an electric current to flow through the coils for generating a magnetic flux through the main cores in a direction to cancel the magnetic flux through the main cores from the permanent magnet, wherein when each of the coils is not energized the associated armature is attracted toward the associated main core to resiliently deform the associated left spring, and when each of the coils is energized the associated armature is released and moved forward to the action of the associated leaf spring, and the rear surface of each of the armatures is kept in contact with the front end of the associated auxiliary core so that the front end of the associated auxiliary core so that the front end of the associated auxiliary core forms a fulcrum point for swinging of the associated armature.

8. A print head according to claim 7, wherein said first magnetic path means includes a substantially disk-shaped rear yoke connecting the permanent magnets and the main cores, and an armature yoke having one end adjacent to a front or side surface of each armature and having another end magnetically coupled to the permanent magnet.

9. A print head according to claim 8, wherein the auxiliary cores extend forward from the rear yoke.

10. A print head according to claim 8, wherein said armature yoke has protrusions, each of which has a side surface adjacent to a side surface of a respective one of the armatures.

11. A print head according to claim 10, wherein said armature yoke has an annular part and said protrusions extend rearwardly from the annular part so that each protrusion is positioned between the adjacent armatures.

12. A print head according to claim 10, wherein each protrusions are opposite to said main cores so that the magnetic flux from the permanent magnet through the main cores passes dominantly through the armature yoke back to the permanent magnet.

* * * * *